US011132931B2

(12) United States Patent
Hayasaki

(10) Patent No.: US 11,132,931 B2
(45) Date of Patent: Sep. 28, 2021

(54) IMAGE PROCESSING SYSTEM, IMAGE PROCESSING METHOD, AND NON-TRANSITORY STORAGE MEDIUM STORING IMAGE PROCESSING PROGRAM

(71) Applicant: SHARP KABUSHIKI KAISHA, Sakai (JP)

(72) Inventor: Makoto Hayasaki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/097,923

(22) Filed: Nov. 13, 2020

(65) Prior Publication Data

US 2021/0150967 A1 May 20, 2021

(30) Foreign Application Priority Data

Nov. 15, 2019 (JP) ..... JP2019-206946

(51) Int. Cl.
*G09G 3/20* (2006.01)

(52) U.S. Cl.
CPC ..... *G09G 3/2007* (2013.01); *G09G 3/2003* (2013.01); *G09G 2320/0233* (2013.01); *G09G 2320/0242* (2013.01); *G09G 2320/0252* (2013.01); *G09G 2320/0271* (2013.01); *G09G 2360/145* (2013.01)

(58) Field of Classification Search
CPC .. G09G 3/006; G09G 2330/12; G09G 3/2007; G09G 3/2003; G09G 2320/0242; G09G 2320/0252; G09G 2320/0271; G09G 2320/0233; G09G 2360/145
See application file for complete search history.

(56) References Cited

U.S. PATENT DOCUMENTS

2007/0001710 A1* 1/2007 Park ..... G09G 3/3611 324/750.19
2010/0201705 A1* 8/2010 Takahashi ..... H04N 1/62 345/600
2014/0232625 A1* 8/2014 Murase ..... G09G 3/2003 345/89
2019/0287443 A1* 9/2019 Kim ..... G09G 3/006

FOREIGN PATENT DOCUMENTS

JP 2016-006416 A 1/2016

* cited by examiner

*Primary Examiner* — Chad M Dicke
(74) *Attorney, Agent, or Firm* — ScienBiziP, P.C.

(57) ABSTRACT

An image processing system according to the present disclosure includes: a measurement image generator that generates a measurement image in which a plurality of rectangular unit images is arranged, each of the unit images being configured by arranging a plurality of gradation images in a first direction; a correction data generator that generates correction data used to correct display unevenness on the basis of a measured value that is acquired by measuring the measurement image generated by the measurement image generator by using a measuring instrument; and a display unevenness corrector that corrects an input gradation on the basis of the correction data generated by the correction data generator.

10 Claims, 15 Drawing Sheets

FIG. 10

| PATTERN IMAGE | GRADATION PATTERN | | | | | |
|---|---|---|---|---|---|---|
| | T1 | T2 | T3 | T4 | T5 | T6 |
| 1 | 24 | 32 | 40 | 48 | 56 | 64 |
| 2 | 72 | 80 | 88 | 96 | 104 | 112 |
| 3 | 120 | 128 | 136 | 144 | 152 | 160 |
| 4 | 168 | 176 | 184 | 192 | 200 | 208 |
| 5 | 216 | 224 | 232 | 240 | 248 | 256 |

IMAGE PROCESSING SYSTEM, IMAGE PROCESSING METHOD, AND NON-TRANSITORY STORAGE MEDIUM STORING IMAGE PROCESSING PROGRAM

INCORPORATION BY REFERENCE

This application is based upon and claims the benefit of priority from the corresponding Japanese Patent Application No. 2019-206946 filed on Nov. 15, 2019, the entire contents of which are incorporated herein by reference.

BACKGROUND OF THE INVENTION

Field of the Invention

The present disclosure relates to an image processing system, an image processing method, and a non-transitory storage medium storing an image processing program, that execute correction processing of display unevenness in a display.

Description of the Background Art

Conventionally, it has been known that a shade differs depending on a position in a display screen, so-called display unevenness occurs. As a technique of correcting this display unevenness, a technique of capturing an image that appears on a display by a measuring instrument, measuring a display characteristic of the display on the basis of captured data, and correcting display data on the basis of the measured display characteristic.

By the way, in the case where the display unevenness of the display screen is corrected, in general, a method for measuring the display characteristic by performing point measurement on image centers of a plurality of gradation images, calculating a correction amount to acquire the desired display characteristic, and correcting the display unevenness for the entire display screen is used with the assumption that the entire screen has the same display characteristic. However, in the case where the display characteristic of the display screen varies, the display unevenness cannot appropriately be corrected with this method. In addition, in the case where a measuring instrument (a surface luminance meter or the like) capable of making two-dimensional measurement is used, it is possible to measure variations in the display characteristic in the display screen. However, in the case where the number of measured colors for calculating the display characteristic is increased, a measurement time is extended. This causes a problem that a processing time for the correction processing of the display unevenness is increased.

SUMMARY

The present disclosure has a purpose of providing an image processing system, an image processing method, and a non-transitory storage medium storing an image processing program capable of reducing display unevenness while reducing a processing time for correction processing of display unevenness in a display.

An image processing system according to an aspect of the present disclosure is an image processing system that measures a measurement image shown on a display by a measuring instrument and corrects display unevenness of the display on the basis of a measured value, and includes: a measurement image generator that generates the measurement image in which a plurality of rectangular unit images is arranged, each of the unit images being configured by arranging a plurality of gradation images in a first direction; a correction data generator that generates correction data used to correct the display unevenness on the basis of the measured value that is acquired by measuring the measurement image generated by the measurement image generator by using the measuring instrument; and a display unevenness corrector that corrects an input gradation on the basis of the correction data generated by the correction data generator.

An image processing method according to another aspect of the present invention is an image processing method that measures a measurement image shown on a display by a measuring instrument and corrects display unevenness of the display on the basis of a measured value. The image processing method causes one or a plurality of processors to execute: generating the measurement image in which a plurality of rectangular unit images is arranged, each of the unit images being configured by arranging a plurality of gradation images in a first direction; generating correction data used to correct the display unevenness on the basis of the measured value that is acquired by measuring the measurement image generated in the measurement image generation by using the measuring instrument; and correcting an input gradation on the basis of the correction data generated in the correction data generation.

A non-transitory storage medium according to another further aspect of the present disclosure is a non-transitory storage medium storing an image processing program that measures a measurement image shown on a display by a measuring instrument and corrects display unevenness of the display on the basis of a measured value, and causes one or a plurality of processors to execute: generating the measurement image in which a plurality of rectangular unit images is arranged, each of the unit images being configured by arranging a plurality of gradation images in a first direction; generating correction data used to correct the display unevenness on the basis of the measured value that is acquired by measuring the measurement image generated in the measurement image generation by using the measuring instrument; and correcting an input gradation on the basis of the correction data generated in the correction data generation.

According to the present disclosure, it is possible to reduce the display unevenness while shortening a processing time of display unevenness correction processing in the display.

This summary is provided to introduce a selection of concepts in a simplified form that are further described below in the detailed description with reference where appropriate to the accompanying drawings. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 10 is a table illustrating an example of the pattern image that is used for the measurement processing according to the embodiment of the present disclosure.

DESCRIPTION OF THE PREFERRED EMBODIMENTS

A description will hereinafter be made on an embodiment of the present disclosure with reference to the accompanying drawings. The following embodiment is an example in which the present disclosure is embodied, and does not intend to limit the technical scope of the present disclosure.

A description will hereinafter be made on this embodiment with reference to the drawings. First, a description will be made on a configuration of an image processing system according to this embodiment.

[Configuration of Image Processing System]

Figure 1:
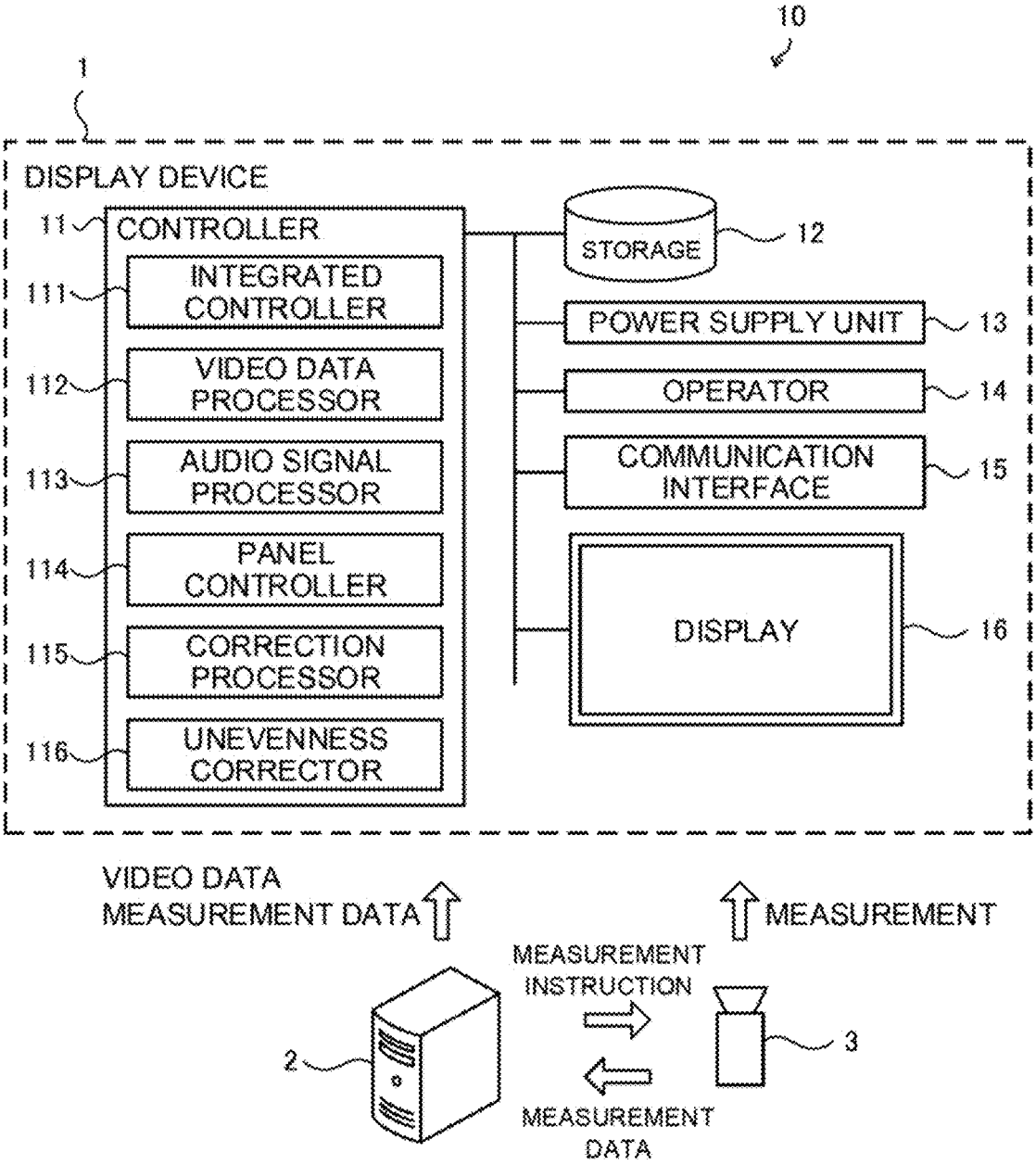
FIG. 1 is a block diagram illustrating a schematic configuration of an image processing system according to an embodiment of the present disclosure.

As illustrated in FIG. 1, an image processing system 10 according to this embodiment includes a display device 1, a system controller (a computer) 2, and a measuring instrument 3. The display device 1 includes a controller 11, a storage 12, a power supply unit 13, an operator 14, a communication interface 15, and a display 16. The image processing system 10 uses the measuring instrument 3 to measure a pattern image P (an example of the measurement image in the present disclosure) that appears on the display 16, and corrects (calibrates) display unevenness of the display 16 on the basis of a measured value (an XYZ value).

Although not illustrated, the communication interface 15 includes: a Digital Visual Interface (DVI) terminal and a High-Definition Multimedia Interface (HDMI®) terminal for serial communication by a transition minimized differential signaling (TMDS) method; and a LAN terminal, an RS232C terminal, and the like for communication using a communication protocol such as Transmission Control Protocol (TCP) or User Datagram Protocol (UDP); a DisplayPort (DP) terminal; and the like.

According to an instruction from an integrated controller 111, which will be described below, in the controller 11, the communication interface 15 exchanges data with external equipment that is connected to the DVI terminal, the HDMI® terminal, the DisplayPort terminal, the LAN terminal, the RS232C terminal, or the like. The communication interface 15 may further include a USB terminal and an IEEE1394 terminal.

The storage 12 is an information storage device such as a hard disk or semiconductor memory, and saves various types of the data that are handled by the controller 11. Furthermore, in this embodiment, as will be described below, in the case where a correction processor 115 in the controller 11 generates a correction lookup table (LUC) that is used at the time of correcting the display unevenness, the correction LUT is stored in the storage 12.

The controller 11 is a computer or a control circuit that controls the display device 1, and includes the integrated controller 111, a video data processor 112, an audio signal processor 113, a panel controller 114, the correction processor 115, and a display unevenness corrector 116.

The integrated controller 111 integrally controls each unit of the hardware in the display device 1. When receiving video data (data on a video that appears on the display 16) from the system controller 2 via the communication interface 15, the video data processor 112 executes specific processing on this video data. The video data that is handled in this embodiment is assumed to be 8 bits (0 to 255). The audio signal processor 113 executes specific processing on an audio signal (a signal of audio that is output from a speaker of the display 16) that is received from the system controller 2 via the communication interface 15.

The correction processor 115 executes correction processing, which will be described below, to calculate a correction amount per pixel for correction of the display unevenness, and generates correction amount information indicative of the correction amount (correction data) per pixel. Furthermore, the correction processor 115 uses this correction data to generate the correction LUT, which is used to correct the display unevenness, and saves the correction LUT in the storage 12.

The display unevenness corrector 116 refers to the correction LUT, which is saved in the storage 12, and adjusts a gradation value of the video data of the video shown on the display 16. In this way, the display unevenness corrector 116 makes the display unevenness correction to correct the display unevenness of the display 16 (color unevenness and luminance unevenness will collectively be referred to as the "display unevenness"). The display unevenness corrector 116 may make the display unevenness correction on the video data that has been processed by the video data processor 112, or may make the display unevenness correction on the video data before being processing by the video data processor 112.

The panel controller 114 controls the display 16 and causes the display 16 to show the video of the video data, which has been processed by the video data processor 112 and the display unevenness corrector 116.

The power supply unit 13 controls electric power that is supplied from the outside. The integrated controller 111 causes the power supply unit 13 to supply the electric power or to cut off a supply of the electric power according to an operation instruction that is received from a power supply switch (not illustrated) provided in the operator 14. In the case where the operation instruction that is received from the power supply switch is the operation instruction to switch to power on, the power supply unit 13 supplies the electric power to each unit of the hardware in the display device 1. In the case where the operation instruction that is received from the power supply switch is the operation instruction to switch to power off, the power supply unit 13 cuts off the electric power supplied to each unit of the hardware in the display device 1.

The display 16 is a display panel such as a liquid-crystal panel, a plasma display panel, or an organic EL panel, for example, and shows the video when being controlled by the panel controller 114. In this embodiment, as illustrated in FIG. 1, an example in which the display 16 includes the single display panel is described. However, the display 16 may be a multi-display in which a plurality of the display panels is arranged.

The operator 14 is an operation member used by a user to enter various instructions. The operator 14 includes the power supply switch (not illustrated). The power supply switch is a switch used to enter the operation instruction that instructs switching between power on and off. When receiving the operation instruction from the power supply switch, the operator 14 outputs this operation instruction to the integrated controller 111.

The measuring instrument 3 includes input/output terminals such as USB, RS232C, and CameraLink. Based on a measurement instruction from the system controller 2, the measuring instrument 3 measures (specifies colors of) the pattern image P (the measurement image) shown on the display 16, and transmits a measurement result to the system controller 2. More specifically, the measuring instrument 3 captures the pattern image P shown on a display screen of the display 16. Then, the measuring instrument 3 outputs, as measurement data, the measured value (for example, the measured value such as the XYZ value, a Lab values, or an RGB value) per pixel by the measuring instrument 3, which is acquired by the imaging. As the measuring instrument 3, a surface luminance meter such as a Luminance & Chromaticity Uniformity Analyzer (UA-1000A or the like) manufactured by TOPCON TECHNOHOUSE CORPORATION or a 2D Color Analyzer (CA-2000 or the like) manufactured by KONICA MINOLTA, INC., a high-definition digital camera manufactured by NIKON CORPORATION or Sony Corporation, an industrial camera, or the like can be used.

In addition, it is desired to make the measurement with the single measuring instrument by using a measuring instrument capable of capturing the image of the entire display 16 at once. However, in some cases, a plurality of the measuring instruments may be used to capture the image of the entire display 16, or the measuring instrument may be moved and join a plurality of pieces of partially measured data. In this way, the measurement data may be acquired.

When the display 16 is measured, a tool (an application) that allows data exchange with the measuring instrument 3 is installed in the system controller 2, and the measuring instrument 3 is used by being connected to the system controller 2 through USB connection, for example. Here, a measurer may cause the display 16 to show the pattern image P to be measured, then may measure the pattern image P by using the measuring instrument 3, and may save the measurement data in a sequential manner. However, there are a plurality (several tens of gradations) of the pattern images P. Thus, when the operation instructions for display and imaging are repeatedly generated for the number of the required pattern images P, it takes time and troublesome, which possibly leads to an erroneous operation. To handle such a problem, the system controller 2 preferably controls the display 16 and the measuring instrument 3, and causes the display 16 and the measuring instrument 3 to automatically perform a series of operation including the "image display", the "measurement", "saving of the measurement data", and "changing of the image".

In addition, it is efficient when the system controller 2 sets measurement conditions (a shutter speed, an aperture, a focus, the number of measurements, and the like for imaging by the camera) of the measuring instrument 3, data management (data saving), and the like.

Figure 2A:
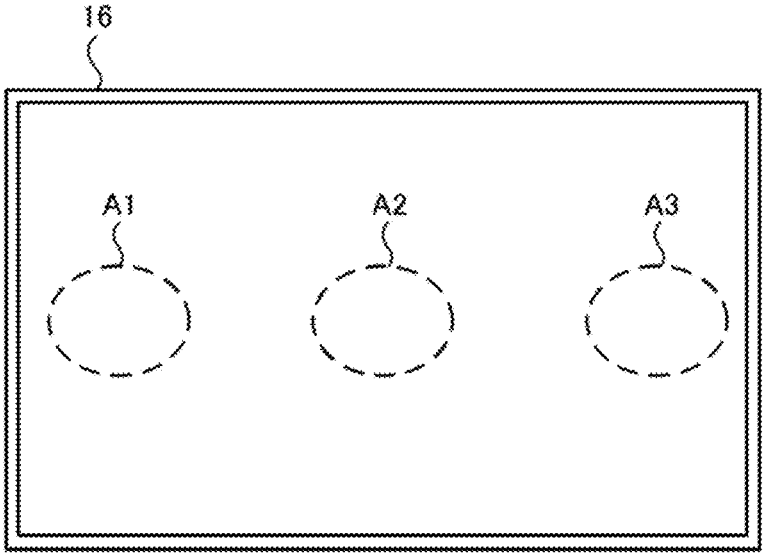
FIG. 2A is a view illustrating an example of a display screen of a display according to a reference aspect.
Figure 2B:
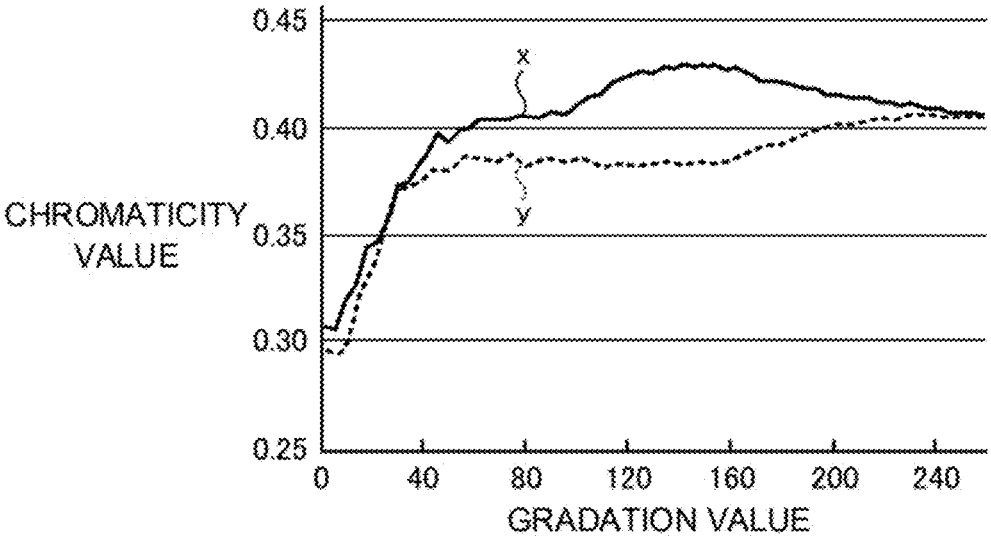
FIG. 2B is a graph illustrating how a chromaticity value changes with respect to a gradation value in a left region of the display screen of the display according to the reference aspect.
Figure 2C:
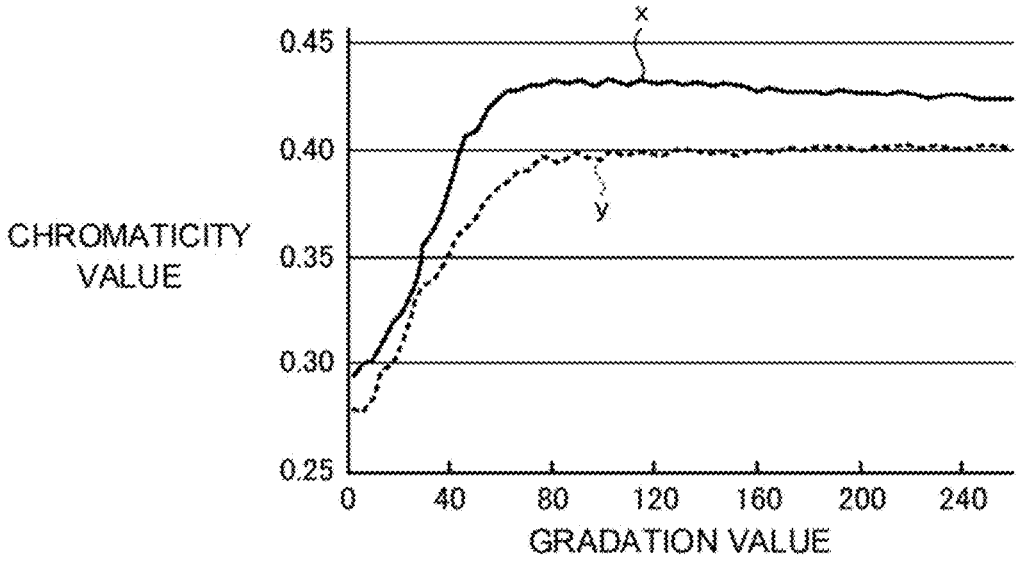
FIG. 2C is a graph illustrating how the chromaticity value changes with respect to the gradation value in a center region of the display screen of the display according to the reference aspect.
Figure 2D:
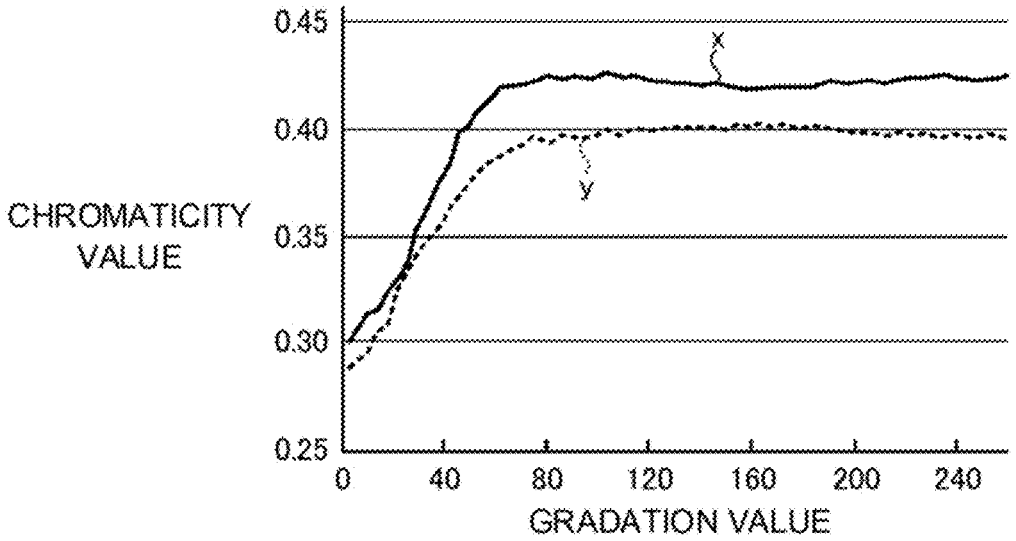
FIG. 2D is a graph illustrating how the chromaticity value changes with respect to the gradation value in a right region of the display screen of the display according to the reference aspect.

By the way, it has been known that the display unevenness occurs to the display device 1 due to a different display characteristic by position in the display screen. FIG. 2A to FIG. 2D each illustrate an example of the display unevenness. FIG. 2B is a graph illustrating a relationship between a gradation and an xy chromaticity value in a left region A1 (see FIG. 2A) of the display screen. FIG. 2C is a graph illustrating a relationship between the gradation and the xy chromaticity value in a center region A2 (see FIG. 2A) of the display screen. FIG. 2D is a graph illustrating a relationship between the gradation and the xy chromaticity value in a right region A3 (see FIG. 2A) of the display screen. Here, in the display device 1, a gray image (R=G=B=N, N=1 to 255) having various gradations is shown, spot measurement is performed on the left region A1, the center region A2, and the right region A3 of the display screen by using the measuring instrument 3, color coordinates in an XYZ color space is calculated, and the xy chromaticity value is calculated and plotted from the color coordinates.

The chromaticity value x, y is acquired from $x=X/(X+Y+Z)$, $y=Y/(X+Y+Z)$.

As illustrated in FIG. 2B to FIG. 2D, it is understood that, when the gradation is changed and plotted in the color (gray) with a certain hue, there is a case where a shade is slightly changed according to the gradation and a change characteristic differs by position. For example, in the case where 80 gradations or more are available, the change characteristics of the chromaticity values x, y differ from each other in the left region A1 of the display screen, and the change characteristics of the chromaticity values x, y also differ from each other similarly in the right region A3 of the display screen. Meanwhile, in the center region A2 of the display screen, the change characteristics of the chromaticity values x, y are substantially the same. Just as described, in the examples of FIG. 2, the shaded image is shown in the left region A1 of the display screen in comparison with that in the center region A2. Similarly, also in the right region A3, the shaded image is shown in comparison with that in the center region A2. Furthermore, the change characteristic of the shade differs between the left region A1 and the right region A3. Accordingly, it is understood that the display characteristic differs in a right-left direction.

It has generally been known to use a 1D-LUT when such a display characteristic is corrected. That is, in the case where an input gradation of each RGB is converted into a desired gradation by using the 1D-LUT, the hue can be corrected by individually changing the gradation value per RGB. However, due to the above-mentioned difference in the display characteristic, the correction amount is also changed per local region. Accordingly, for example, in the case where the shade of the focused gray display is corrected, it is necessary to measure the color in the vicinity thereof. That is, in the case where the display characteristic is checked per local region, it is necessary to measure the focused color (gray) to be corrected and the colors near the focused color (for example, at least three colors acquired by slightly changing the RGB) in each of the regions. Although depending on a configuration of the 1D-LUT, in the case of the 1D-LUT which has 33 correction points and in which the rest of the points are interpolated, 30 points other than dark parts (0, 8, 16), control of which is originally difficult, are measured, and a total of 120 colors including the focused colors and the vicinity colors has to be measured.

While a time required for the spot measurement is short, the spot measurement has to be made per local region. In addition, in the case where a two-dimensional measuring instrument is used, it is possible to limit and calculate the measurement data per local region after the measurement. However, it takes a considerable amount of time to measure 120 colors, and an amount of data to be processed is enormous. To handle such a problem, the measurement pattern image P is used to execute the correction processing for a realistic time and with realistic data capacity. For the measurement pattern image, only the certain number of the gradation and the vicinity colors are provided, and the basic display characteristic of the display 16 is further considered. The image processing system 10 according to this embodiment is characterized by using the pattern image P, for which the processing time and the data capacity are considered.

A description will hereinafter be made on a specific configuration of the correction processing using the pattern image P in this embodiment.

[Correction Processing]

After the measuring instrument 3 measures the pattern image P shown on the display 16, the correction processor 115 acquires the measurement data that is acquired by the measurement, and executes the correction processing on the basis of the measurement data. In the following description, data acquired from the single pattern image P corresponds to a single piece of the measurement data. That is, the single piece of the measurement data is a collection of the data that is acquired by capturing the single pattern image P, and is a collection of the measured values (the XYZ values), each of which is acquired per pixel, by the measuring instrument 3.

Figure 3:
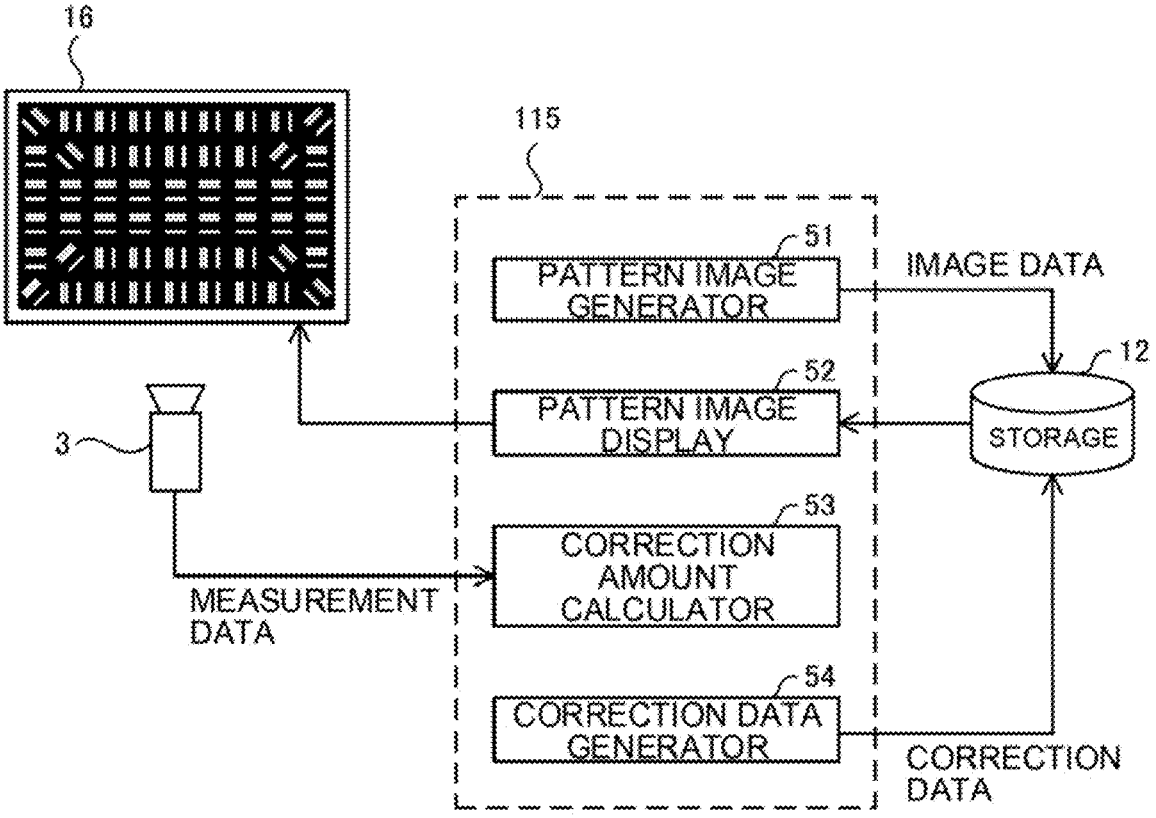
FIG. 3 is a block diagram illustrating a configuration of a correction processing section according to the embodiment of the present disclosure.

FIG. 3 is a block diagram illustrating a schematic configuration of the correction processor 115. As illustrated in FIG. 3, the correction processor 115 includes a pattern image generator 51, a pattern image display 52, a correction amount calculator 53, and a correction data generator 54.

Figure 4:
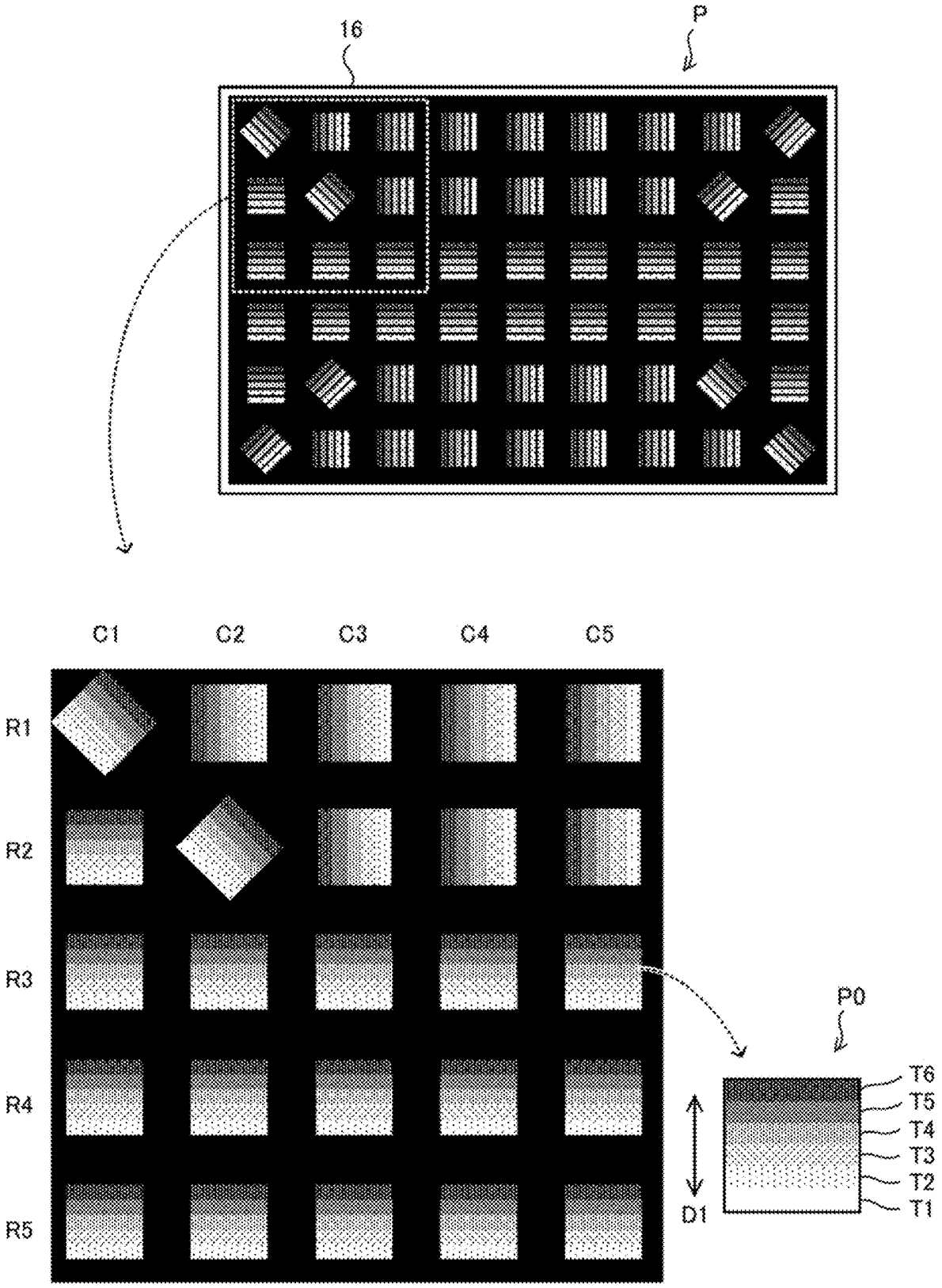
FIG. 4 is a view illustrating an example of a pattern image according to the embodiment of the present disclosure.

The pattern image generator 51 generates the pattern image P that is the correction (measurement) image used for the correction processing. The pattern image generator 51 is an example of the measurement image generator of the present disclosure. FIG. 4 is a view illustrating an example of the pattern image P. FIG. 4 also illustrates an enlarged view of a part (an upper left region) of the display screen of the display 16 and an enlarged view of a basic pattern P0. More specifically, the pattern image generator 51 generates the pattern image P in which a plurality of the rectangular basic patterns P0 (an example of a unit image of the present disclosure) is arranged. The rectangular basic pattern P0 is configured that a plurality of gradation images (gradation patterns) is arranged in an arrangement direction D1 (an example of the first direction of the present disclosure). The pattern image P includes: a background image (for example, a black image); and the plurality of the basic patterns P0 (in the gray colors) that is arranged in a row direction (a horizontal direction) and a column direction (a vertical direction).

For example, the basic pattern P0 is formed in a square shape of a dozen pixels×a dozen pixels, and has a plurality of the gradation patterns. Here, as an example, the basic pattern P0 having six gradation patterns T1 to T6 is illustrated. In each of the basic patterns P0, the gradation patterns T1 to T6 are formed in the same strip (rectangular) shape, and are arranged in an order of a low gradation to a high gradation. For example, the gradation pattern T1 is configured as an image having 24 gradations to 56 gradations, the gradation pattern T2 is configured as an image having 64 gradations to 88 gradations, the gradation pattern T3 is configured as an image having 96 gradations to 120 gradations, the gradation pattern T4 is configured as an image having 128 gradations to 160 gradations, the gradation pattern T5 is configured as an image having 168 gradations to 224 gradations, and the gradation pattern T6 is configured as an image having 232 gradations to 255 gradations.

The pattern image generator 51 arranges the basic patterns P0 according to the display characteristic of the display 16, and thereby generates the pattern image P. For example, as illustrated in FIG. 2B and FIG. 2D, in the case where the display 16 has such a display characteristic that causes the display unevenness in the right-left direction in the display screen, the pattern image generator 51 arranges the basic patterns P0 such that the arrangement direction D1 (the example of the first direction of the present disclosure) of the gradation patterns T1 to T6 is orthogonal to the direction (the right-left direction) in which the display unevenness occurs. In this way, the pattern image generator 51 generates the pattern image P. In addition, in a peripheral region (upper, lower, right, and left end portions) of the display screen, the display unevenness is likely to occur from the center region to the peripheral region due to a luminance gradient or the like. Similarly, in each corner region of the display screen, the display unevenness is likely to occur from the center region toward the corner region due to the luminance gradient or the like. Accordingly, the pattern image generator 51 arranges the basic patterns P0 such that the arrangement direction D1 of the gradation patterns T1 to T6 is orthogonal to a direction (a diagonal direction) from the center region toward the corner of the display screen. In this way, the pattern image generator 51 generates the pattern image P.

In the center region A2 of the display screen, the basic patterns P0 are arranged such that the arrangement direction D1 of the gradation patterns T1 to T6 is orthogonal to the right-left direction in which the display unevenness occurs.

Meanwhile, in the peripheral region (for example, an R1 row and an R2 row) of the display screen in an up-down direction, the basic patterns P0 are arranged such that the arrangement direction D1 of the gradation patterns T1 to T6 is parallel to the upper periphery and the lower periphery. That is, the basic patterns P0 are arranged such that a long side direction of each of the gradation patterns T1 to T6 is orthogonal to the upper periphery and the lower periphery. Similarly, in the peripheral region (for example, a C1 column and a C2 column) of the display screen in the right-left direction, the basic patterns P0 are arranged such that the arrangement direction D1 of the gradation patterns T1 to T6 is parallel to a left periphery and a right periphery. That is, the basic patterns P0 are arranged such that the long side direction of each of the gradation patterns T1 to T6 is orthogonal to the left periphery and the right periphery. Furthermore, in the corner region (for example, the R1 row and the C1 column, the R2 row and the C2 column) of the display screen, the basic patterns P0 are arranged such that the arrangement direction D1 of the gradation patterns T1 to T6 is orthogonal to the direction (the diagonal direction) from the center region toward the corner of the display screen. That is, the basic patterns P0 are arranged such that the long side direction of each of the gradation patterns T1 to T6 is parallel to the diagonal direction. In this way, the basic patterns P0 arranged in the corner region are arranged such that the arrangement direction D1 of the gradation patterns T1 to T6 is a diagonal direction (for example, 45 degrees) with respect to the arrangement direction D1 of the basic patterns P0 arranged in the other regions. However, all the basic patterns P0 constituting the pattern image P may be arranged such that the arrangement direction D1 of each thereof is orthogonal to a radial direction from the center region toward the periphery and the corner.

It is possible to appropriately detect the luminance unevenness, especially, in the right-left direction of the pattern image P (see FIG. 4) by the above-described arrangement method. While maintaining the arrangement method illustrated in FIG. 4, in order to further detect the display unevenness caused by the difference in the shade in the right-left direction, the pattern image generator 51 generates a pattern (hereinafter referred to as a shift pattern P1) in which the color tone is changed with the basic pattern P0 being a reference.

More specifically, the pattern image generator 51 arranges the basic patterns P0 (an example of the first unit image of the present disclosure), in each of which the plurality of the gradation images has the gray gradations, and the shift patterns P1 (an example of the second unit image of the present disclosure), in each of which the plurality of the gradation images has color gradations. In this way, the pattern image generator 51 generates the pattern image P.

For example, the shift patterns P1 includes: an image (an example of the R unit image of the present disclosure), an R value of which is shifted with respect to the gray gradation; an image (an example of the G unit image of the present disclosure), a G value of which is shifted with respect to the gray gradation; and an image (an example of the B unit image of the present disclosure) a B value of which is shifted with respect to the gray gradation. The pattern image generator 51 arranges the shift pattern P1, the R value of which is shifted, the shift pattern P1, the G value of which is shifted, and the shift pattern P1, the B value of which is shifted, around the basic pattern P0. In this way, the pattern image generator 51 generates the pattern image P.

Figure 5:
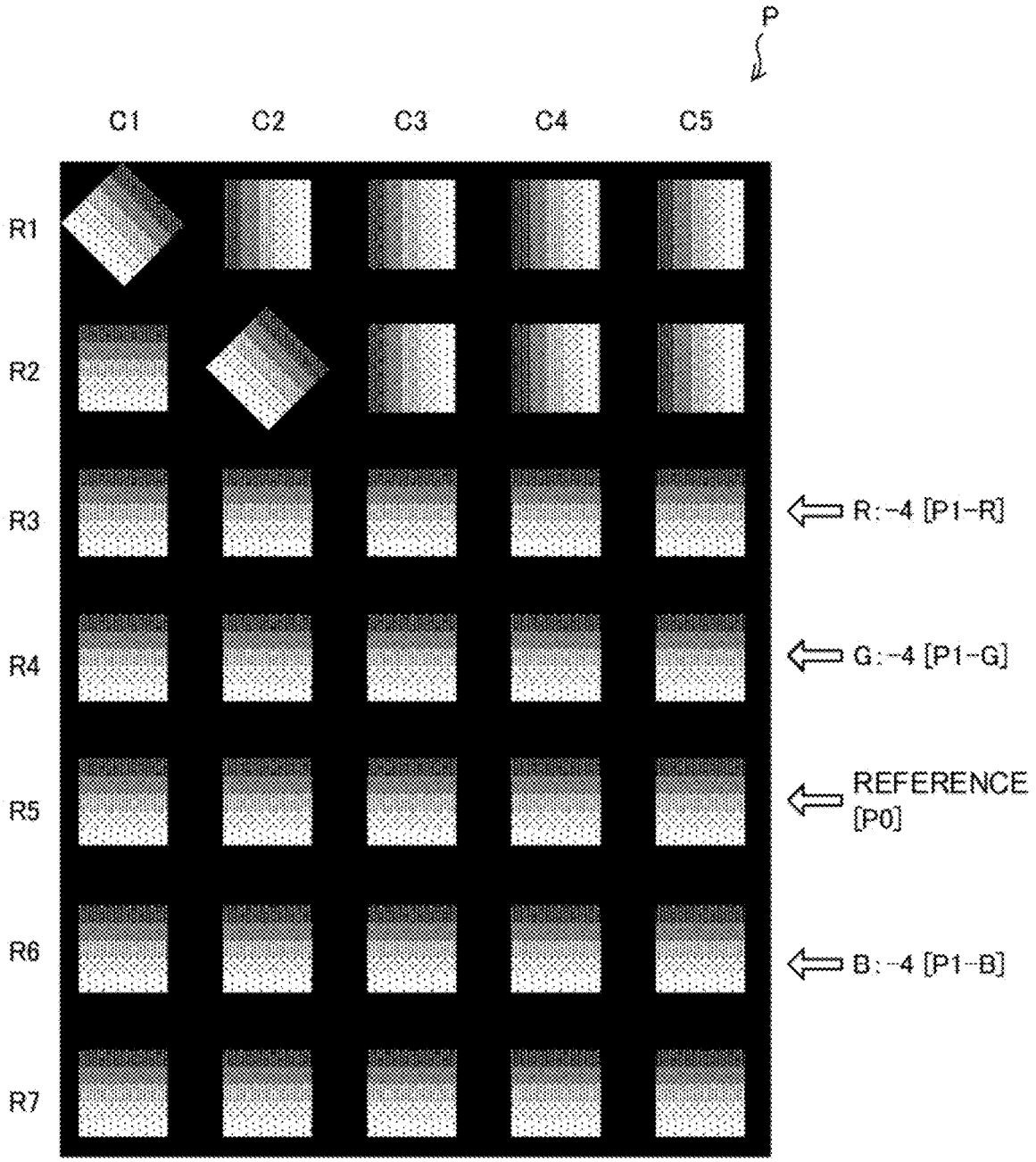
FIG. 5 is a view illustrating an example of the pattern image according to the embodiment of the present disclosure.

For example, as illustrated in FIG. 5, the pattern image generator 51 generates the image (an example of the R unit image of the present disclosure) by lowering (shifting) the R value of the shift pattern P1 in the third row (an R3 row) by four with respect to the basic pattern P0 in the fifth row (an R5 row). For example, in the case where the RGB value of each of the gradation patterns T1 to T6 in the basic pattern P0 is (Rt, Gt, Bt), the RGB value of each of the gradation patterns T1 to T6 in the shift pattern P1 in the third row (the R3 row) is set to (Rt−4, Gt, Bt).

In addition, the pattern image generator 51 generates the image (an example of the G unit image of the present disclosure) by lowering the G value of the shift pattern P1 in a fourth row (an R4 row) by four with respect to the basic pattern P0 in the fifth row (the R5 row). For example, in the case where the RGB value of each of the gradation patterns T1 to T6 in the basic pattern P0 is (Rt, Gt, Bt), the RGB value of each of the gradation patterns T1 to T6 in the shift pattern P1 in the fourth row (the R4 row) is set to (Rt, Gt−4, Bt).

Furthermore, the pattern image generator 51 generates the image (an example of the B unit image of the present disclosure) by lowering the B value of the shift pattern P1 in a sixth row (an R6 row) by four with respect to the basic pattern P0 in the fifth row (the R5 row). For example, in the case where the RGB value of each of the gradation patterns T1 to T6 in the basic pattern P0 is (Rt, Gt, Bt), the RGB value of each of the gradation patterns T1 to T6 in the shift pattern P1 in the sixth row (the R6 row) is set to (Rt, Gt, Bt−4).

The pattern image generator 51 sets the RGB value of each of the gradation patterns T1 to T6 in the shift pattern P1 in the third row from a lower end of the display screen to (Rt−4, Gt, Bt), sets the RGB value of each of the gradation patterns T1 to T6 in the shift pattern P1 in the fourth row from the lower end of the display screen to (Rt, Gt−4, Bt), and sets the RGB value of each of the gradation patterns T1 to T6 in the shift pattern P1 in the sixth row from the lower end of the display screen to (Rt, Gt, Bt−4). In addition, the pattern image generator 51 arranges the basic patterns P0 in the center region.

The pattern image generator 51 saves the generated pattern image P (image data) in the storage 12. According to the pattern image P illustrated in FIG. 5, it is possible to detect the display unevenness caused by the difference in the shade in the right-left direction.

The pattern image display 52 causes the display 16 to show the pattern image P, which is generated by the pattern image generator 51. More specifically, according to the instruction from the system controller 2, the pattern image display 52 acquires the pattern image P from the storage 12, and causes the panel controller 114 to execute display processing on the display 16. In this way, for example, the pattern image P illustrated in FIG. 5 is shown on the entire display screen of the display 16.

The correction amount calculator 53 calculates the correction amount used for the display unevenness correction on the basis of the measurement data of the pattern image P, which is measured by the measuring instrument 3 during the correction processing, on the display 16.

The measurement data is the measured value (the XYZ value) per pixel that is measured by the measuring instrument 3 at the time when the pattern image P (see FIG. 5) having the specific RGB values is shown during the correction processing in each of the display devices 1, and is data that differs by the display device 1.

Information that is acquired as a variation in the display unevenness at the time of calculating the correction amount is the measured value (the XYZ value) per pixel. The correction amount calculator 53 calculates the correction amount from this measured value (the measured color value). More specifically, the correction amount calculator 53 calculates a coefficient (a conversion coefficient) of a 3×3 matrix in a manner to match the characteristic of the display device 1, and thereby calculates the correction amount by an equation (1).

[Equation 1]

$$\begin{bmatrix} R \\ G \\ B \end{bmatrix} = \begin{bmatrix} Ka & Kb & Kc \\ Kd & Ke & Kf \\ Kg & Kh & Ki \end{bmatrix} * \begin{bmatrix} X \\ Y \\ Z \end{bmatrix} \quad (1)$$

More specifically, the correction amount calculator 53 calculates the coefficient by using a difference between the measured value (the XYZ value) of the basic pattern P0 (gray) in FIG. 5 measured by the measuring instrument 3 and the measured value (the XYZ value) of each of the shift pattern P1-R, the R value of which is lowered by four, the shift pattern P1-G, the G value of which is lowered by four, and the shift pattern P1-B, the B value of which is lowered by four. In the case where the above difference is used, the equation (1) can be expressed by the following equation (2). That is, it is possible to calculate a change amount of the XYZ value with respect to a change amount of the RGB value by using the equation (2). Then, it is possible to calculate the correction amount corresponding to the display characteristic of the display device 1 by calculating the coefficient corresponding to the display characteristic thereof.

[Equation 2]

$$\begin{bmatrix} \Delta R1 & \Delta R2 & \Delta R3 \\ \Delta G1 & \Delta G2 & \Delta G3 \\ \Delta B1 & \Delta B2 & \Delta B3 \end{bmatrix} = \begin{bmatrix} Ka & Kb & Kc \\ Kd & Ke & Kf \\ Kg & Kh & Ki \end{bmatrix} * \begin{bmatrix} \Delta X1 & \Delta X2 & \Delta X3 \\ \Delta Y1 & \Delta Y2 & \Delta Y3 \\ \Delta Z1 & \Delta Z2 & \Delta Z3 \end{bmatrix} \quad (2)$$

For example, in order to calculates coefficients Ka to Ki in the above equation (2), the correction amount calculator 53 uses difference values (ΔR1, ΔG1, ΔB1), (ΔR2, ΔG2, ΔB2), (ΔR3, ΔG3, ΔB3) of the three RGB values and difference values (ΔX1, ΔY1, ΔZ1), (ΔX2, ΔY2, ΔZ2), (ΔX3, ΔY3, ΔZ3) of the three measured values respectively corresponding to the difference values. Here, the difference value (ΔR1, ΔG1, ΔB1) is, for example, a difference between the RGB value of the shift pattern P1-R (for example, in the R3 row), the R value of which is lowered by four, and the RGB value of the basic pattern P0 (for example, in the R5 row). The difference value (ΔR2, ΔG2, ΔB2) is, for example, a difference between the RGB value of the shift pattern P1-G (for example, in the R4 row), the G value of which is lowered by four, and the RGB value of the basic pattern P0 (for example, in the R5 row). The difference value (ΔR3, ΔG3, ΔB3) is, for example, a difference between the RGB values of the shift pattern P1-B (for example, the R6 row), the B value of which is lowered by four and the RGB value of the basic pattern P0 (for example, in the R5 row).

The correction amount calculator 53 calculates the coefficients Ka to Ki by assigning the difference value of each of the RGB values and the difference value of each of the measured values into the following equation (3).

[Equation 3]

$$\begin{bmatrix} Ka & Kb & Kc \\ Kd & Ke & Kf \\ Kg & Kh & Ki \end{bmatrix} = \begin{bmatrix} \Delta R1 & \Delta R2 & \Delta R3 \\ \Delta G1 & \Delta G2 & \Delta G3 \\ \Delta B1 & \Delta B2 & \Delta B3 \end{bmatrix} * \begin{bmatrix} \Delta X1 & \Delta X2 & \Delta X3 \\ \Delta Y1 & \Delta Y2 & \Delta Y3 \\ \Delta Z1 & \Delta Z2 & \Delta Z3 \end{bmatrix}^{-1} \quad (3)$$

The correction amount calculator 53 assigns the calculated coefficients Ka to Ki into Ka to Ki in the equation (1), calculates the difference between the measured value (the XYZ value) corresponding to the basic pattern P0 (gray) and the measured value (the XYZ value) corresponding to the shift pattern P1, and assigns the calculated difference into (X, Y, Z) in the equation (1). In this way, the correction amount calculator 53 calculates the correction amount. Just as described, it is possible to calculate the correction amount of the RGB value of the pattern image P per pixel or per same color region. The calculation method by the correction amount calculator 53 is not limited thereto, and a well-known method can be adopted.

The correction data generator 54 generates the correction data to correct the display unevenness on the basis of the measured value (the XYZ value) of the pattern image P, which is generated by the pattern image generator 51 and measured by the measuring instrument 3. More specifically, the correction data generator 54 generates the correction amount information (the correction data) indicative of a corresponding relationship between the RGB value (the input gradation) and the correction amount. The correction data generator 54 generates the correction data per pixel, for example. The correction data generator 54 stores, as the correction LUT, the generated correction data in the storage 12.

As described above, the correction processor 115 generates the correction LUT that is used to correct the display unevenness. The configuration of the correction processor 115 is not limited to the above-described configuration. For example, the pattern image generator 51 may generate the pattern image P illustrated in FIG. 6.

More specifically, the pattern image generator 51 divides the basic pattern P0 into two by a division line extending in the arrangement direction D1. Then, the pattern image generator 51 arranges the gray image (an example of the first division unit image of the present disclosure), in which a plurality of the gradation patterns has the gray gradations, in a first region and an image (an example of the second division unit image of the present disclosure), in which the plurality of the gradation patterns has color gradations, in a second region, and thereby generates the pattern image P.

Here, the image having the color gradations includes: an R division unit image, the R value of which is shifted with respect to the gray gradation; and a G division unit image, the G value of which is shifted with respect to the gray gradation; and a B division unit image, the B value of which is shifted with respect to the gray gradation. The pattern image generator 51 alternately arranges a shift pattern P2, which includes the gray image and the R division unit image, and the shift pattern P2, which includes the gray image and the G division unit image, and alternately arranges the shift pattern P2, which includes the gray image and the R division unit image, and the shift pattern P2, which includes the gray image and the B division unit image. In this way, the pattern image generator 51 generates the pattern image P.

Figure 6:
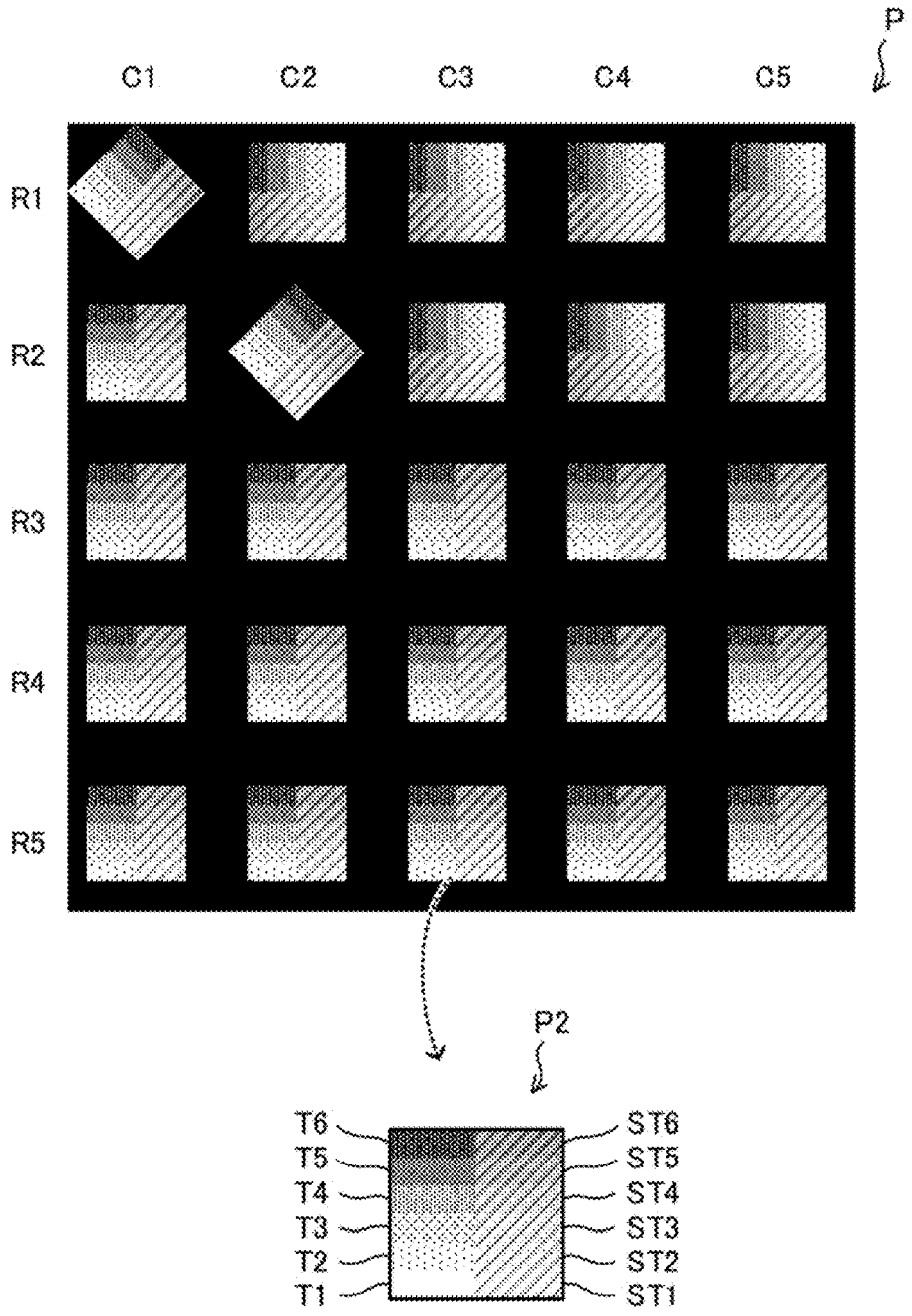
FIG. 6 is a view illustrating an example of the pattern image according to the embodiment of the present disclosure.
Figure 7:
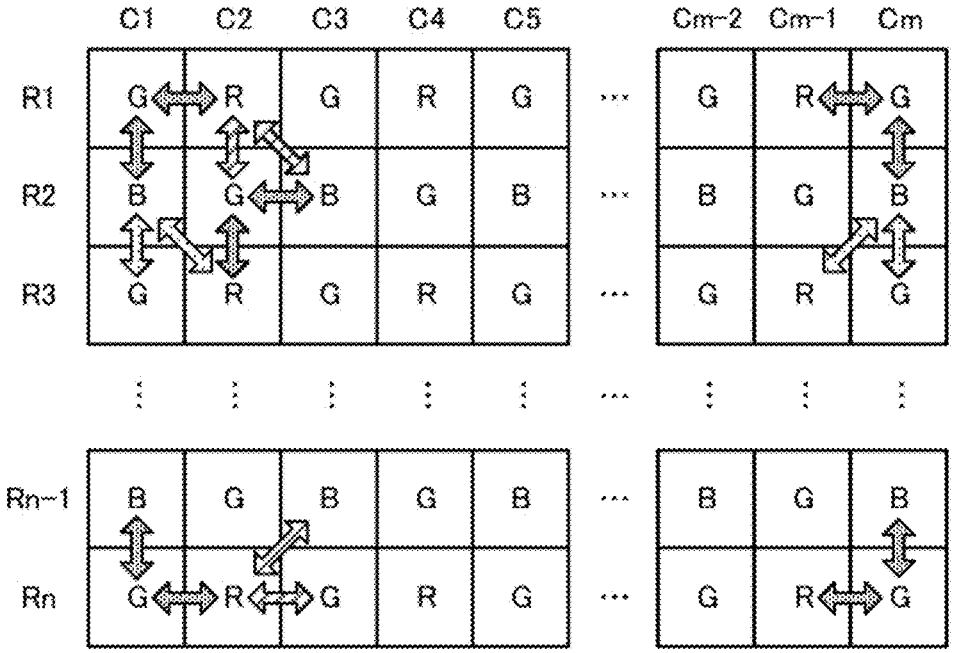
FIG. 7 is a view illustrating an example of the pattern image according to the embodiment of the present disclosure.

For example, as illustrated in FIG. 6, the pattern image generator 51 divides the basic pattern P0 into two to generate the shift pattern P2, arranges the shift pattern P2, and thereby generates the pattern image P. The shift pattern P2 includes: the six gray gradation patterns T1 to T6 corresponding to the basic pattern P0; and shift gradation patterns ST1 to ST6, the RGB value of each of which is lowered by four with the gradation of the basic pattern P0 being the reference. For example, while maintaining the arrangement method illustrated in FIG. 4, the pattern image generator 51 arranges the shift patterns P2 (an example of the R division unit image of the present disclosure), the R value of each of which is lowered by four, in a staggered manner. In addition, in odd-numbered rows, the pattern image generator 51 alternately arranges the shift pattern P2, the R value of which is lowered by four, and the shift pattern P2, the G value of which is lowered by four, (an example of the G division unit image of the present disclosure) in the row direction (the horizontal direction). Furthermore, in even-numbered rows, the pattern image generator 51 alternately arranges the shift pattern P2, the R value of which is lowered by four, and the shift pattern P2, the B value of which is lowered by four, (an example of the B division unit image of the present disclosure) in the row direction (the horizontal direction). In this way, as illustrated in FIG. 7, the pattern image P in a color filter array shape is generated. For convenience, FIG. 7 illustrates the shift patterns P2 next to each other and indicating "R", "G", and "B".

The correction amount calculator 53 calculates the correction amount on the basis of the measurement data of the pattern image P, which is illustrated in FIG. 6 and is measured by the measuring instrument 3. More specifically, as illustrated in FIG. 7, for example, in regard to the shift pattern P2 ("G") in the R1 row and the C1 column, the correction amount calculator 53 calculates the difference from the RGB value of the basic pattern P0 on the basis of the RGB value corresponding to the XYZ value of the shift pattern P2 ("G") in the R1 row and the C1 column, the RGB value corresponding to the XYZ value of the shift pattern P2 ("R") on the right in the R1 row and the C2 column, and the RGB value corresponding to the XYZ value of the shift pattern P2 ("B") on a lower side in the R2 row and the C1 column. In addition, for example, in regard to the shift pattern P2 ("R") in the R1 row and the C2 column, the correction amount calculator 53 calculates the difference from the RGB value of the basic pattern P0 on the basis of the RGB value corresponding to the XYZ value of the shift pattern P2 ("R") in the R1 row and the C2 column, the RGB value corresponding to the XYZ value of the shift pattern P2 ("B") on a lower right side in the R2 row and the C3 column, and the RGB value corresponding to the XYZ value of the shift pattern P2 ("G") on a lower side in the R2 row and the C2 column. Furthermore, for example, in regard to the shift pattern P2 ("B") in the R2 row and the C1 column, the correction amount calculator 53 calculates the difference from the RGB value of the basic pattern P0 on the basis of the RGB value corresponding to the XYZ value of the shift pattern P2 ("B") in the R2 row and the C1 column, the RGB value corresponding to the XYZ value of the shift pattern P2 ("R") on a lower right side in the R3 row and the C2 column, and the RGB value corresponding to the XYZ value of the shift pattern P2 ("G") on a lower side in the R3 row and the C1 column.

Then, the correction amount calculator 53 calculates the correction amount by assigning the calculated difference into (X, Y, Z) of the equation (1). In this way, it is possible to calculate the correction amount of the RGB value of the pattern image P per pixel. In the case where the pattern image illustrated in FIG. 6 is used, and even in the case where the display characteristic differs in the horizontal direction and the vertical direction, it is possible to calculate the correction amount corresponding to the display characteristic.

Figure 8:
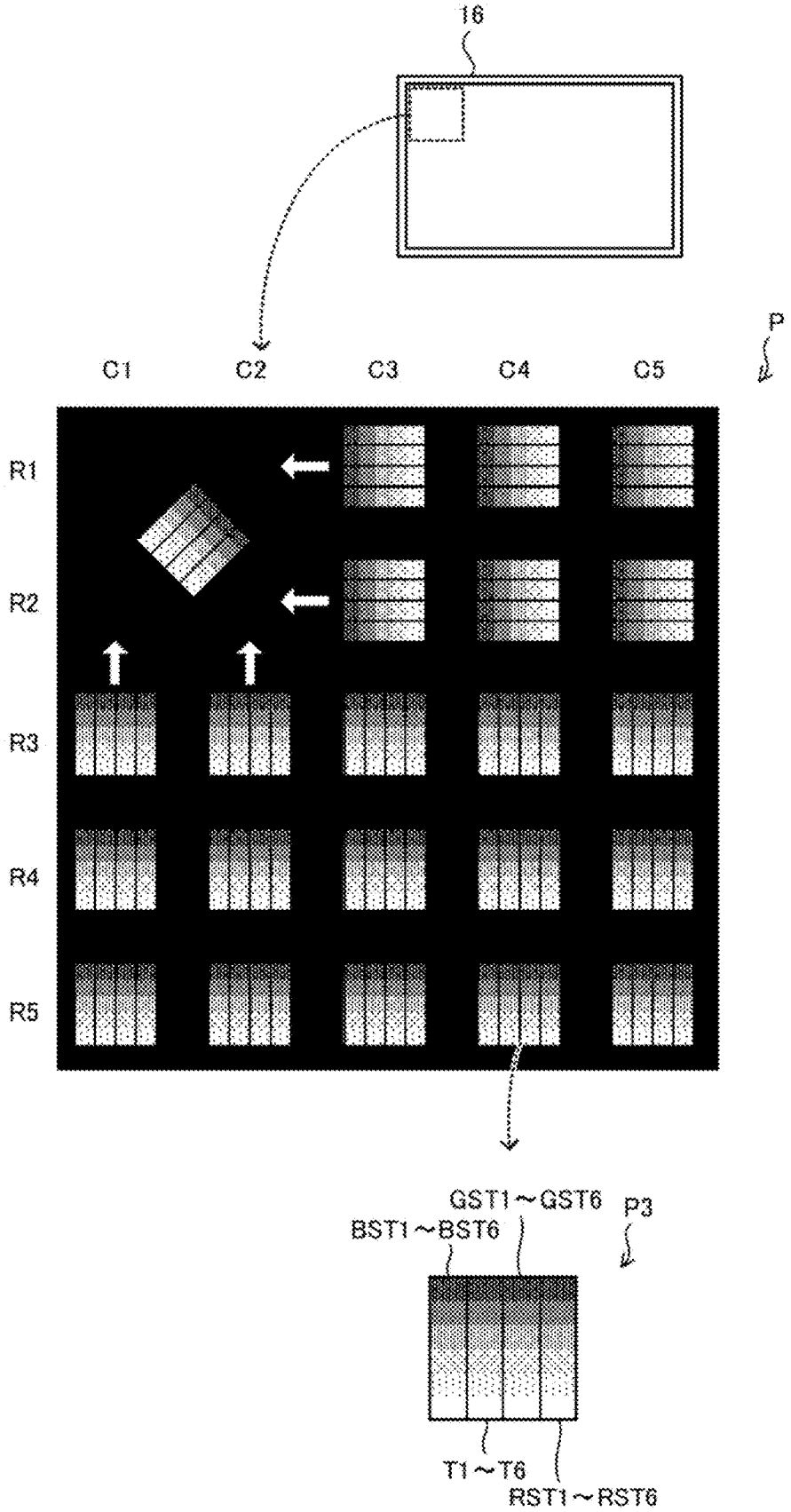
FIG. 8 is a view illustrating an example of the pattern image according to the embodiment of the present disclosure.

Alternatively, the pattern image generator 51 may generate the pattern image P illustrated in FIG. 8.

That is, the pattern image generator 51 divides the basic pattern P0 into four by a division line extending in the arrangement direction D1. Then, the pattern image generator 51 arranges the gray image (an example of the first division unit image of the present disclosure), in which a plurality of the gradation patterns has the gray gradations, in a first region, a first color image (an example of the second division unit image of the present disclosure), in which a plurality of the gradation patterns has the color gradations, in a second region, a second color image (an example of the third division unit image of the present disclosure), in which a plurality of the gradation patterns has second color gradations, in a third region, and a third color image (an example of the fourth division unit image of the present disclosure), in which a plurality of the gradation patterns has third color gradations, in a fourth region. In this way, the pattern image generator 51 generates the pattern image P. The number of the divisions and the number of the color gradations of the basic pattern P0 are not limited. The number of the divisions may be five or more, and the number of the color gradations may be five or more.

Here, the first color image is, for example, an image (an example of the R division unit image of the present disclosure), the R value is shifted with respect to the gray gradation, the second color image is, for example, an image (an example of the G division unit image of the present disclosure), the G value of which is shifted with respect to the gray gradation, the third color image is, for example, an image (an example of the B division unit image of the present disclosure), the B value of which is shifted with respect to the gray gradation.

More specifically, as illustrated in FIG. 8, the pattern image generator 51 divides the basic pattern P0 into four to generate the shift pattern P3, arranges the shift patterns P3, and thereby generates the pattern image P. The shift pattern P3 includes: the six gray gradation patterns T1 to T6 corresponding to the basic pattern P0; R shift gradation patterns RST1 to RST6 (an example of the R division unit image of the present disclosure), the R value of each of which is lowered by four with the gradation of the basic pattern P0 being the reference; G shift gradation patterns GST1 to GST6, the G value of each of which is lowered by four (an example of the G division unit image of the present disclosure); and B shift gradation patterns BST1 to BST6 (an example of the B division unit image of the present disclosure), the B value of which is lowered by four (an example of the B division unit image of the present disclosure). That is, while maintaining the arrangement method illustrated in FIG. 4, the pattern image generator 51 arranges the shift pattern P3 that includes the four gradation patterns having the different gradation values.

The correction amount calculator 53 calculates the correction amount on the basis of the measurement data of the pattern image P, which is illustrated in FIG. 8 and is measured by the measuring instrument 3. In this way, it is possible to calculate the correction amount of the RGB values of the pattern image P per pixel. In the case where the pattern image illustrated in FIG. 8 is used, and even in the case where the display characteristic differs in the horizontal direction and the vertical direction, it is possible to calculate the correction amount corresponding to the display characteristic.

As it has been described so far, the pattern image generator 51 may generate any of the pattern image P illustrated in FIG. 5, the pattern image P illustrated in FIG. 6, and the pattern image P illustrated in FIG. 8, which have been described. Then, the correction amount calculator 53 calculates the correction amount by using any of the above pattern images P. The correction data generator 54 generates the correction LUT that indicates a corresponding relationship between the RGB value (the input gradation) and the correction amount. In regard to each of the pattern image P illustrated in FIG. 5, the pattern image P illustrated in FIG. 6, and the pattern image P illustrated in FIG. 8, the pattern image generator 51 may generate the pattern image P to which the arrangement method illustrated in FIG. 4 is not applied. That is, the pattern image generator 51 may arrange each of the pattern image P illustrated in FIG. 5, the pattern image P illustrated in FIG. 6, and the pattern image P illustrated in FIG. 8 such that the arrangement directions D1 of all the basic patterns and the shift patterns are the same direction (for example, the vertical direction).

The display unevenness corrector 116 (see FIG. 1) corrects the input gradation on the basis of the correction data that is generated by the correction data generator 54. More specifically, the display unevenness corrector 116 corrects the display unevenness with reference to the correction LUT. For example, in the case where the RGB value indicated in the correction LUT is used as an input value (the input gradation), the display unevenness corrector 116 reads the correction amount corresponding to the RGB value from the correction LUT, and uses the correction amount to correct the gradation.

[Measurement Processing]

Figure 9:
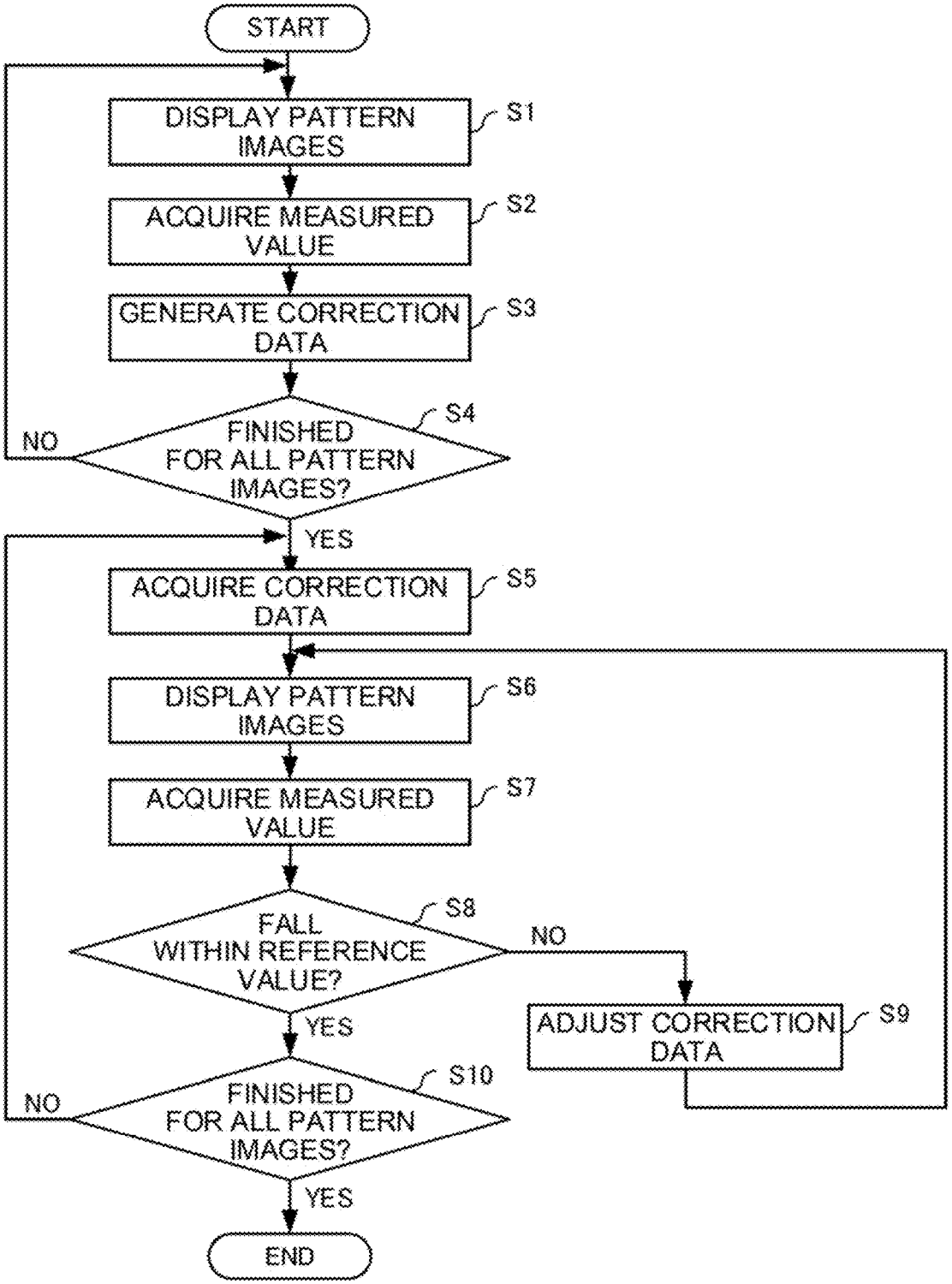
FIG. 9 is a flowchart illustrating an example of a procedure of measurement processing that is executed in the image processing system according to the embodiment of the present disclosure.

A description will herein be made on an example of a procedure of measurement processing that is executed in the image processing system 10. FIG. 9 is a flowchart of an example of the procedure of the measurement processing. Here, it is assumed that the measurement processing is executed by using the pattern image P illustrated in FIG. 8. The measurement processing is executed according to the instruction of the system controller 2 in an inspection step of the display 16, for example. In addition, it is assumed here that 30 gradations are measured by using five types of the pattern images P, in each of which the shift patterns P3 are arranged. The shift pattern P3 includes: the gray gradation patterns T1 to T6 having the six gradations; and the shift gradation patterns, the RGB value of which is shifted (for example, lowered by four) from that of each of the gradation patterns T1 to T6. FIG. 10 illustrates an example of the five types (five sets) of the pattern images P. The gradation values illustrated in FIG. 10 indicate the gradation values of the gradation patterns T1 to T6 (gray).

First, in step S1, the correction processor 115 causes the display 16 to show a first set of the pattern image P illustrated in FIG. 10. More specifically, according to the instruction of the system controller 2, the correction processor 115 causes the display 16 to show the first set of the pattern image P.

Next, in step S2, the correction processor 115 acquires the measured value (the XYZ value) that is measured by the measuring instrument 3 according to the instruction of the system controller 2.

Figure 11A:
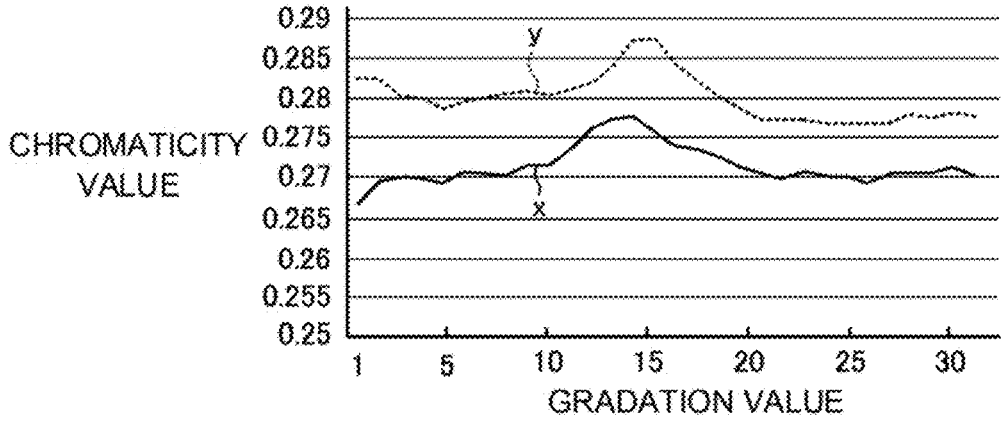
FIG. 11A is a graph illustrating how the chromaticity value changes with respect to the gradation value in the left region of the display screen of the display according to the embodiment of the present disclosure.
Figure 11B:
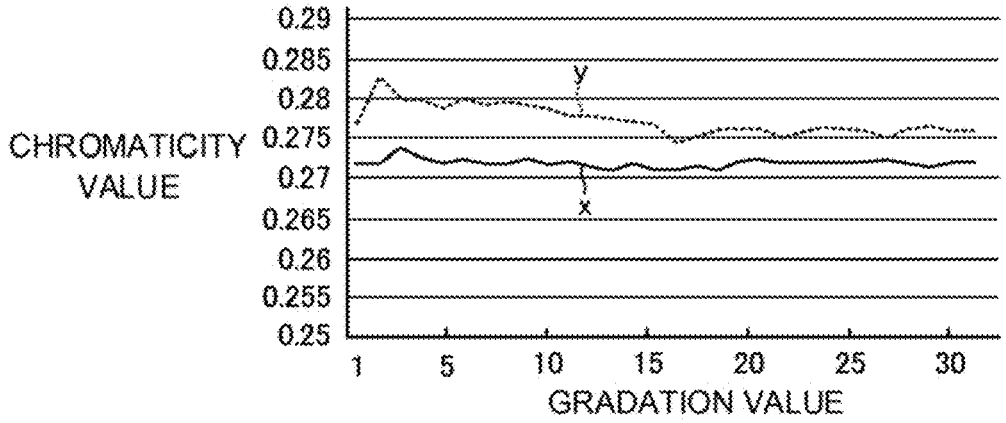
FIG. 11B is a graph illustrating how the chromaticity value changes with respect to the gradation value in the left region of the display screen of the display according to the embodiment of the present disclosure.
Figure 11C:
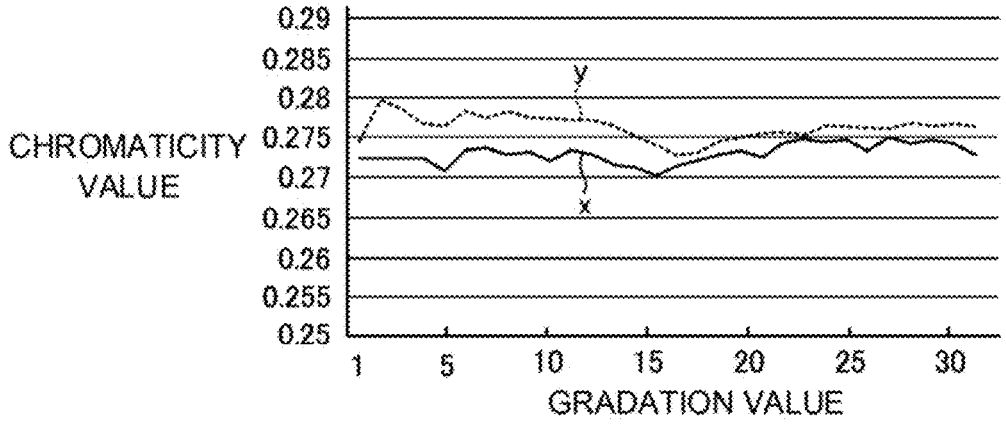
FIG. 11C is a graph illustrating how the chromaticity value changes with respect to the gradation value in the left region of the display screen of the display according to the embodiment of the present disclosure.

FIG. 11A is a graph illustrating a relationship between the gradation and the xy chromaticity value corresponding to the measured value (the XYZ value) in the left region A1 (see FIG. 2A) of the display screen. FIG. 11B is a graph illustrating a relationship between the gradation and the xy chromaticity value corresponding to the measured value (the XYZ value) in the center region A2 (see FIG. 2A) of the display screen. FIG. 11C is a graph illustrating a relationship between the gradation and the xy chromaticity value corresponding to the measured value (the XYZ value) in the right region A3 (see FIG. 2A) of the display screen.

Next, in step S3, the correction processor 115 calculates the correction amount on the basis of the acquired XYZ value, and generates the correction data (the correction LUT) that corresponds to the first set of the pattern image P on the basis of the calculated correction amount. The correction processor 115 saves the generated correction data in the storage 12.

Figure 12:
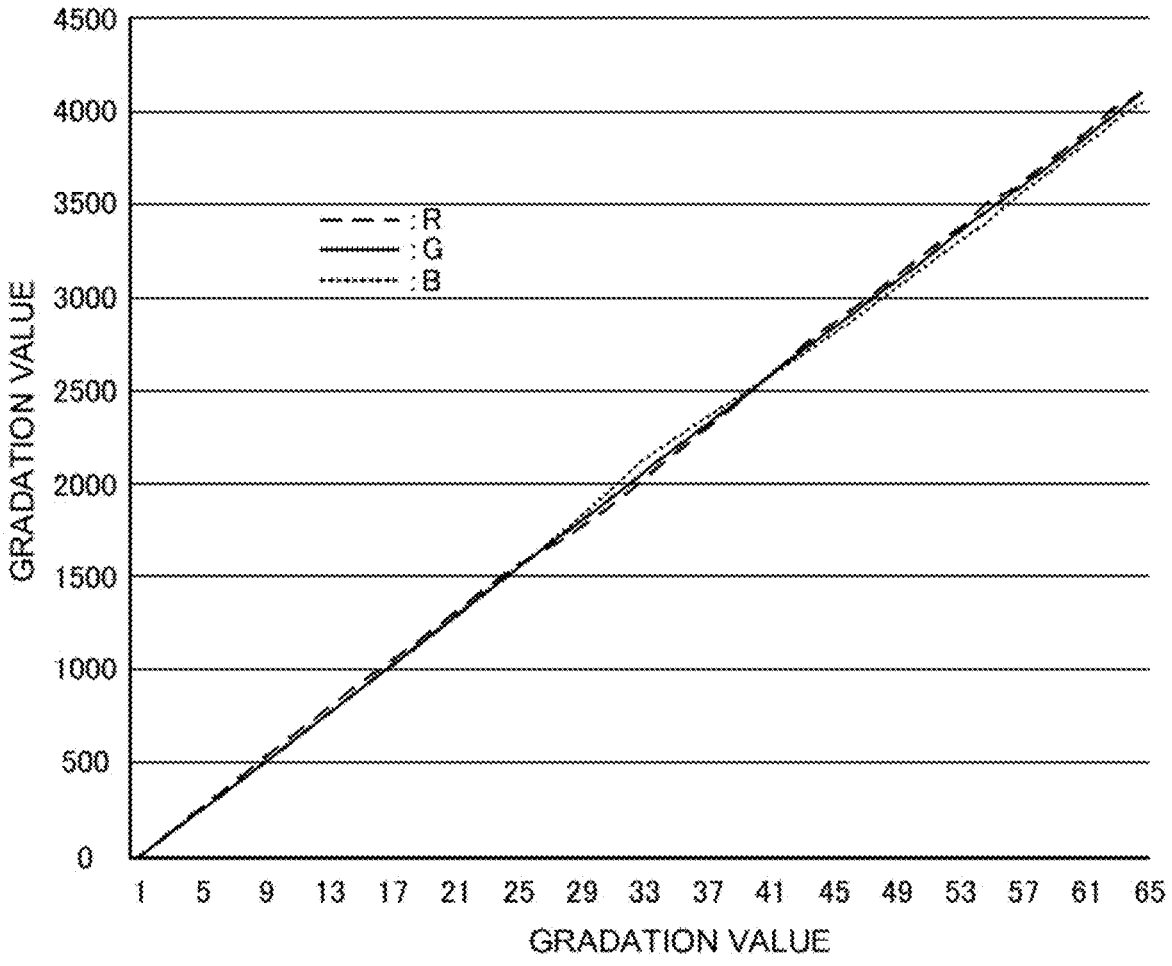
FIG. 12 is a graph illustrating an example of correction data that is generated in the image processing system according to the embodiment of the present disclosure.
Figure 13:
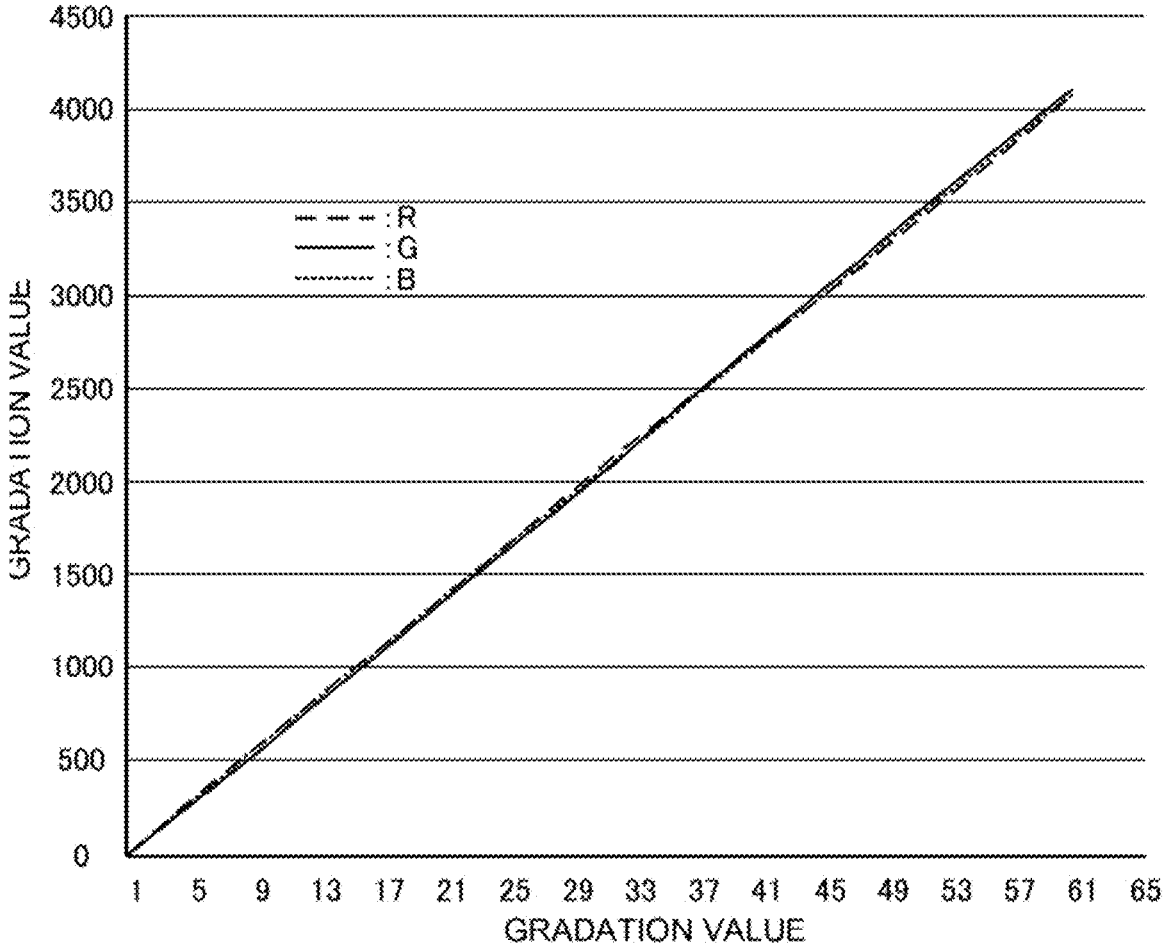
FIG. 13 is a graph illustrating an example of the correction data that is generated in the image processing system according to the embodiment of the present disclosure.

FIG. 12 is an example of the correction data (the correction LUT) that corresponds to the left region A1 of the display screen. FIG. 13 is an example of the correction data (the correction LUT) that corresponds to the center region A2 of the display screen. In FIG. 12 and FIG. 13, a vertical axis represents an output value of the 1D-LUT by a 12-bit gradation value (0 to 4095), and a horizontal axis represents a 6-bit grid point.

The correction processor 115 repeats the processing in steps S1 to S3 for all the pattern images P. Here, the correction processor 115 repeats the processing in steps S1 to S3 for the first set to the fifth set of the pattern images P. The correction processor 115 generates the correction data that corresponds to the first set to the fifth set of the pattern images P, and saves the correction data in the storage 12.

If the correction data is generated for all the pattern images P (S4: YES), in step S5, the correction processor 115 acquires the correction data (the correction LUT) that corresponds to the first set of the pattern image P from the storage 12.

Next, in step S6, the correction processor 115 causes the display 16 to show the first set of the pattern image P on the basis of the correction data. That is, the correction processor 115 uses the RGB value of the first set of the pattern image P as the input gradation, reads the correction amount that corresponds to the RGB value from the correction LUT, corrects the gradation by using the correction amount, causes the display 16 to show the first set of the corrected pattern images P.

Next, in step S7, the correction processor 115 acquires the measured value (the XYZ value) that is measured by the measuring instrument 3 according to the instruction of the system controller 2.

Next, in step S8, the correction processor 115 determines whether the acquired XYZ value falls within a reference value, which is set in advance. Of the six gradations constituting the pattern image P, the correction processor 115 may use any one of the gradations (for example, the gradation pattern T3 illustrated in FIG. 10) for evaluation and thereby execute the determination processing. If the acquired XYZ value does not fall within the reference value (S8: NO), the processing proceeds to step S9. On the other hand, if the measured value (XYZ value) falls within the reference value (S8: YES), the processing proceeds to step S10.

In step S9, the correction processor 115 adjusts the correction data, and generates the correction data again. Thereafter, the processing returns to step S6. The correction processor 115 causes the display 16 to show the first set of the pattern image P again on the basis of the adjusted correction data. If the measured value (the XYZ value) of the pattern image P that is shown again falls within the reference value (S8: YES), the processing proceeds to step S10.

The correction processor 115 repeats the processing in steps S5 to S9 for all the pattern images P (S10: NO). If the measured values (the XYZ values) of all the pattern images P fall within the reference value (S10: YES), the processing is terminated. Just as described, the correction processor 115 evaluates the shown pattern image P, the gradations of which are corrected. Then, the correction processor 115 generates the correction data of the pattern image P, the measured value of which exceeds the reference value, again to correct the gradation, and evaluates the pattern image P again. In this way, the display 16, the display unevenness of which is corrected and the display characteristic of which is thereby made uniform, is completed. The measurement processing may be executed at specific timing (for example, during maintenance) in a period in which the display device 1 is used by the user after shipment.

Figure 14:
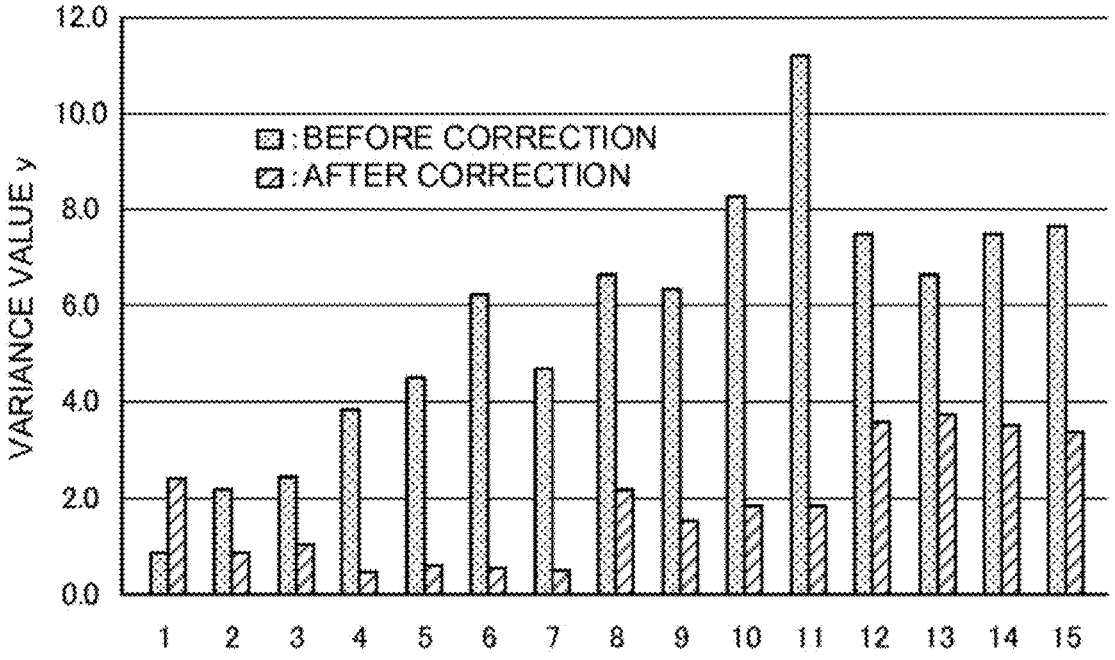
FIG. 14 is a graph used to compare variance values before correction processing and the variance values after the correction processing according to the embodiment of the present disclosure.

FIG. 14 is a graph illustrating the result of the correction processing. In FIG. 14, variance values before the correction and the variance values after the correction are compared and illustrated. For convenience of the description on the comparison, the variance value represents the chromaticity value that is increased thousandfold. In FIG. 14, an average variance value before the correction is 5.891, and an average variance value after the correction is 1.953. From the result illustrated in FIG. 14, it is understood that the change in the shade is suppressed by the correction processing.

As it has been described so far, in the image processing system 10 according to this embodiment, the pattern, which includes the plurality (for example, 4 to 8) of the gradation patterns, is arranged according to the display characteristic (the display unevenness or the luminance gradient) of the display screen. More specifically, a wide range of the gradations from black (dark) to white (bright) is arranged at fine intervals over an entire surface of the display screen (see FIG. 4). In addition, the shift pattern P1, the RGB color of which is shifted by several gradations with respect to the basic pattern P0 (gray), is arranged near the basic pattern P0 (see FIG. 5). Furthermore, in order to reduce an influence of the display unevenness of the periphery of the display screen, the pattern on the peripheral side is arranged such that the arrangement direction D1 of the gradation patterns T1 to T6 is parallel to the periphery of the display screen. In this way, the measuring instrument 3 such as a two-dimensional colorimeter can evenly and collectively make measurements corresponding to the plurality of the gradations over the entire display screen in a short time. Then, the image with the excellent uniformity can be shown by the correction data that is based on the measured value. Thus, it is possible to reduce the display unevenness of the display 16 while shortening the processing time of the correction processing of the display unevenness.

The correction processor 115 and the display unevenness corrector 116 of the display device 1 according to the embodiment described so far may be realized by a logic circuit (hardware) formed in an integrated circuit (an IC chip) or the like, or may be realized by software using a Central Processing Unit (CPU).

In the latter case, the display device 1 includes: a CPU that executes a program command as software exerting each function; read only memory (ROM) or a storage device (hereinafter these will be referred to as a "recording medium") in which the above program and various types of data are recorded in a computer-readable manner; random access memory (RAM) that loads the above program; and the like. The object of the present disclosure is achieved when the computer reads and executes the above program from the recording medium. As the recording medium, a "non-temporary tangible medium" such as a tape, a disk, a card, semiconductor memory, or a programmable logic circuit can be used. Further, the above program may be supplied to the computer via an arbitrary transmission medium (a communication network, a broadcast wave, or the like) capable of transmitting the program. The present disclosure can also be realized in a form of a data signal which is embedded in a carrier wave and by which the above program is embodied by electronic transmission.

The image processing system 10 according to the embodiment of the present disclosure may be realized by a computer. In this case, a program that operates the computer as each means provided in the image processing system 10 so as to realize the image processing system 10 by the computer, and a computer-readable recording medium that records the program also fall within the scope of the present disclosure.

The image processing method according to the present disclosure can be described as follows. That is, the image processing method is the image processing method that measures the measurement image shown on the display by the measuring instrument and corrects the display unevenness of the display on the basis of the measured value. The image processing method causes one or a plurality of processors to execute: generating the measurement image in which the plurality of the rectangular unit images is arranged, each of the unit images being configured by arranging the plurality of the gradation images in the first direction; generating the correction data used to correct the display unevenness on the basis of the measured value that is acquired by measuring the measurement image generated in the measurement image generation by using the measuring instrument; and correcting the input gradation on the basis of the correction data generated in the correction data generation.

The non-transitory storage medium storing an image processing program according to the present disclosure can be described as follows. That is, the non-transitory storage medium is a non-transitory storage medium storing an image processing program that measures the measurement image shown on the display by the measuring instrument and corrects the display unevenness of the display on the basis of the measured value. The image processing medium causes one or a plurality of processors to execute: generating the measurement image in which the plurality of the rectangular unit images is arranged, each of the unit images being configured by arranging the plurality of the gradation images in the first direction; generating the correction data used to correct the display unevenness on the basis of the measured value that is acquired by measuring the measurement image generated in the measurement image generation by using the measuring instrument; and correcting the input gradation on the basis of the correction data generated in the correction data generation.

The image processing system of the present disclosure may be realized by the image processing system 10 (see FIG. 1) according to this embodiment or may be realized by the display device 1 according to this embodiment. The image processing system of the present disclosure may be realized by a server that includes the correction processor 115 and the display unevenness corrector 116.

The present disclosure is not limited to each of the above-described embodiments, and various modifications can be made thereto within the scope indicated by the claims. An embodiment that can be implemented by appropriately combining technical means disclosed in the different embodiments also falls within the technical scope of the present disclosure. Furthermore, new technical features can be created by combining the technical means disclosed in the embodiments.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image processing system that measures a measurement image shown on a display by a measuring instrument and corrects display unevenness of the display on the basis of a measured value, the image processing system comprising:

a memory that stores instructions; and a processor that executes the instructions stored in the memory to:

generate the measurement image in which a plurality of rectangular unit images is arranged, each of the unit images being configured by arranging a plurality of gradation images in a first direction;

generate correction data used to correct the display unevenness on the basis of the measured value that is acquired by measuring the measurement image generated by using the measuring instrument; and correct an input gradation on the basis of the correction data generated, and arrange the unit images and generate the measurement image such that the first direction of the unit image arranged at a corner of a display screen of the display is orthogonal to a direction from a center region of the display screen toward the corner.

2. The image processing system according to claim 1, wherein the unit images are arranged according to a display characteristic of the display and thereby the measurement image is generated.

3. The image processing system according to claim 1, wherein the unit images include first unit images and second unit images, and the first unit images in which the plurality of the gradation images has gray gradations and the second unit images in which the plurality of the gradation images has color gradations are arranged, and thereby the measurement image is generated.

4. The image processing system according to claim 3, wherein the second unit images include R second unit images, an R value of which is shifted with respect to the gray gradation, G second unit images, a G value of which is shifted with respect to the gray gradation, and B second unit images, a B value of which is shifted with respect to the gray gradation, and the R second unit images, the G second unit images, and the B second unit images are arranged around the first unit image and thereby the measurement image is generated.

5. The image processing system according to claim 1, wherein the unit images include third unit images, and each of the third unit images is divided into a first region and a second region by a division line extending in the first direction, a plurality of gray gradation images is arranged in the first region, a plurality of color gradation images is arranged in the second region, and the measurement image generator generates the measurement image by arranging the plurality of gray gradation images and the plurality of color gradation images.

6. The image processing system according to claim 5, wherein the third unit images include R third unit images, G third unit images, and B third unit images, the R third unit images include the plurality of gray gradation images and a plurality of R color gradation images, an R value of which is shifted with respect to the gray gradation, the G third unit images include the plurality of gray gradation images and a plurality of G color gradation images, a G value of which is shifted with respect to the gray gradation, the B third unit images include the plurality of gray gradation images and a plurality of B color gradation images, a B value of which is shifted with respect to the gray gradation, the R third unit images and the G third unit images are alternately arranged in first row, and the G third unit images and the B third unit images are alternately arranged in second row, and thereby the measurement image is generated.

7. The image processing system according to claim 1, wherein the unit images include fourth unit images, each of the fourth unit images is divided into a first region, a second region, a third region, and a fourth region by three division lines extending in the first direction, a plurality of gray gradation images is arranged in the first region, a plurality of first color gradation images is arranged in the second region, a plurality of second color gradation images is arranged in the third region, a plurality of third color gradation images is arranged in the fourth region, and the measurement image generator generates the measurement image by arranging the plurality of gray gradation images, the plurality of first color gradation images, the plurality of second color gradation images, and the plurality of third color gradation images.

8. The image processing system according to claim 7, wherein the plurality of first color gradation images is an R division unit image, an R value of which is shifted with respect to the gray gradation, the plurality of second color gradation images is a G division unit image, a G value of which is shifted with respect to the gray gradation, and the plurality of third color gradation images is a B division unit image, a B value of which is shifted with respect to the gray gradation.

9. An image processing system that measures a measurement image shown on a display by a measuring instrument and corrects display unevenness of the display on the basis of a measured value, the image processing system comprising:

a memory that stores instructions; and a processor that executes the instructions stored in the memory to:

generate the measurement image in which a plurality of rectangular unit images is arranged, each of the unit images being configured by arranging a plurality of gradation images in a first direction;

generate correction data used to correct the display unevenness on the basis of the measured value that is acquired by measuring the measurement image generated by using the measuring instrument; and correct an input gradation on the basis of the correction data generated, wherein each of the unit images is divided into a first region and a second region by a division line extending in the first direction, a plurality of gray gradation images is arranged in the first region, a plurality of color gradation images is arranged in the second region, the measurement image is generated by arranging the plurality of gray gradation images and the plurality of color gradation images, the unit images include R unit images, G unit images, and B unit images, the R unit images include the plurality of gray gradation images and a plurality of R color gradation images, an R value of which is shifted with respect to the gray gradation, the G unit images include the plurality of gray gradation images and a plurality of G color gradation images, a G value of which is shifted with respect to the gray gradation, the B unit images include the plurality of gray gradation images and a plurality of B color gradation images, a B value of which is shifted with respect to the gray gradation, the R unit images and the G unit images are alternately arranged in first row, and the G unit images and the B unit images are alternately arranged in second row, and thereby the measurement image is generated.

10. An image processing system that measures a measurement image shown on a display by a measuring instrument and corrects display unevenness of the display on the basis of a measured value, the image processing system comprising:

a memory that stores instructions; and a processor that executes the instructions stored in the memory to:

generate the measurement image in which a plurality of rectangular unit images is arranged, each of the unit images being configured by arranging a plurality of gradation images in a first direction;

generate correction data used to correct the display unevenness on the basis of the measured value that is acquired by measuring the measurement image generated by using the measuring instrument; and correct an input gradation on the basis of the correction data generated, wherein each of the unit images is divided into a first region, a second region, a third region, and a fourth region by three division lines extending in the first direction, a plurality of gray gradation images is arranged in the first region, a plurality of first color gradation images is arranged in the second region, a plurality of second color gradation images is arranged in the third region, a plurality of third color gradation images is arranged in the fourth region, and the measurement image is generated by arranging the plurality of gray gradation images, the plurality of first color gradation images, the plurality of second color gradation images, and the plurality of third color gradation images.

* * * * *